US010460640B2

(12) United States Patent
Yoon et al.

(10) Patent No.: US 10,460,640 B2
(45) Date of Patent: Oct. 29, 2019

(54) DISPLAY APPARATUS AND METHOD OF OPERATING THE SAME

(71) Applicant: SAMSUNG DISPLAY CO., LTD., Yongin-si, Gyeonggi-Do (KR)

(72) Inventors: Young-Soo Yoon, Seoul (KR); Joon-Chul Goh, Hwaseong-si (KR); Sang-Ik Lee, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 481 days.

(21) Appl. No.: 15/155,624

(22) Filed: May 16, 2016

(65) Prior Publication Data

US 2017/0061927 A1 Mar. 2, 2017

(30) Foreign Application Priority Data

Aug. 26, 2015 (KR) ..... 10-2015-0120412

(51) Int. Cl.

| | |
|---|---|
| ***G09G 5/06*** | (2006.01) |
| ***G09G 3/20*** | (2006.01) |
| ***G09G 3/3275*** | (2016.01) |
| ***G09G 3/36*** | (2006.01) |
| ***G09G 5/02*** | (2006.01) |

(52) U.S. Cl.

CPC ..... *G09G 3/20* (2013.01); *G09G 3/2003* (2013.01); *G09G 3/3275* (2013.01); *G09G 3/3685* (2013.01); *G09G 5/026* (2013.01); *G09G 2310/027* (2013.01); *G09G 2320/0204* (2013.01); *G09G 2320/0257* (2013.01); *G09G 2320/0285* (2013.01); *G09G 2320/0613* (2013.01); *G09G 2320/0673* (2013.01)

(58) Field of Classification Search

None

See application file for complete search history.

(56) References Cited

U.S. PATENT DOCUMENTS

2008/0129762 A1* 6/2008 Shiomi ..... G09G 3/3648 345/690

2010/0315447 A1* 12/2010 Ozone ..... G09G 3/2007 345/690

(Continued)

FOREIGN PATENT DOCUMENTS

KR 10-1279297 6/2013

KR 10-2015-0073713 7/2015

*Primary Examiner* — Benjamin C Lee

*Assistant Examiner* — Krishna P Neupane

(74) *Attorney, Agent, or Firm* — F. Chau & Associates, LLC

(57) ABSTRACT

A display apparatus may include a display timing controller and a display panel. The display timing controller generates first output image data based on first input image data and a first gamma function, and generates second output image data based on second input image data and a second gamma function. The display panel operates based on the first output image data during a first duration, and operates based on the second output image data during a second duration subsequent to the first duration. The first and second gamma functions correspond to a first region of the display panel, and a luminance of an image based on the first gamma function is different from a luminance of an image based on the second gamma function.

20 Claims, 11 Drawing Sheets

(56) References Cited

U.S. PATENT DOCUMENTS

| | | | | |
|---|---|---|---|---|
| 2012/0182280 | A1* | 7/2012 | Park | G09G 3/3648 345/211 |
| 2014/0306984 | A1* | 10/2014 | Choi | G09G 5/06 345/591 |
| 2015/0187303 | A1* | 7/2015 | Choi | G09G 3/20 345/691 |
| 2015/0339805 | A1* | 11/2015 | Ohba | G06F 3/011 345/156 |
| 2017/0187958 | A1* | 6/2017 | Shiohara | H04N 5/23245 |

* cited by examiner

DISPLAY APPARATUS AND METHOD OF OPERATING THE SAME

CROSS-REFERENCE TO RELATED APPLICATION

This application claims priority under 35 USC § 119 to Korean Patent Application No. 10-2015-0120412, filed on Aug. 26, 2015 in the Korean Intellectual Property Office (KIPO), the contents of which are herein incorporated by reference in their entirety.

TECHNICAL FIELD

The inventive concept relates generally to displaying images, and more particularly to display apparatuses and methods of operating the display apparatuses.

DISCUSSION OF RELATED ART

A liquid crystal display apparatus is a type of flat panel display (FPD), which is widely used in recent years. The FPD may include, but is not limited to, a liquid crystal display (LCD), a plasma display panel (PDP) and an organic light emitting display (OLED), for example.

A display panel in the display apparatus includes a plurality of pixels. Each pixel includes a pixel electrode receiving a data voltage and a common electrode receiving a common voltage. An image having a target luminance may be displayed on the display panel based on a difference between the data voltage and the common voltage. However, a residual direct current (DC) voltage can be generated in the display panel due to various reasons, such as a discord between an electric center of the data voltage and the common voltage. The residual DC voltage can cause an afterimage or a sticking image.

SUMMARY

At least one exemplary embodiment of the present disclosure provides a display apparatus capable of high display quality.

At least one exemplary embodiment of the present disclosure provides a method of operating the display apparatus.

According to an exemplary embodiment, a display apparatus includes a timing controller and a display panel. The timing controller generates first output image data based on first input image data and a first gamma lookup table, and generates second output image data based on second input image data and a second gamma lookup table. The display panel operates based on the first output image data during a first duration, and operates based on the second output image data during a second duration subsequent to the first duration. The first and second gamma lookup tables correspond to a first region of the display panel, and a luminance of an image based on the first gamma lookup table is different from a luminance of an image based on the second gamma lookup table.

In an exemplary embodiment, the timing controller may further perform a temporal smoothing operation to reduce discontinuity between the first output image data and the second output image data during a third duration between the first duration and the second duration.

The timing controller may further generate at least one smoothing image data by performing an interpolation based on the first output image data and the second output image data. The display panel may operate based on the at least one smoothing image data during the third duration.

In an exemplary embodiment, the luminance of the image based on the first gamma lookup table may be higher than the luminance of the image based on the second gamma lookup table.

In an exemplary embodiment, a residual direct current (DC) voltage in the display panel may increase during the first duration and may decrease during the second duration.

In an exemplary embodiment, the timing controller may further generate third output image data based on third input image data and a third gamma lookup table, and may further generate fourth output image data based on fourth input image data and one of the third gamma lookup table and a fourth gamma lookup table. The display panel may operate based on the first output image data and the third output image data during the first duration, and may operate based on the second output image data and the fourth output image data during the second duration. The third and fourth gamma lookup tables may correspond to a second region of the display panel, and a luminance of an image based on the third gamma lookup table may be different from the luminance of the image based on the first gamma lookup table and a luminance of an image based on the fourth gamma lookup table.

In an exemplary embodiment, the timing controller may further perform a spatial smoothing operation to reduce discontinuity between the first output image data and the third output image data during the first duration.

In an exemplary embodiment, the timing controller may further generate third output image data based on third input image data and the first gamma lookup table, and may further generate fourth output image data based on fourth input image data and the second gamma lookup table. The display panel may operate based on the third output image data during a third duration subsequent to the second duration, and may operate based on the fourth output image data during a fourth duration subsequent to the third duration.

In an exemplary embodiment, the timing controller may further generate third output image data based on third input image data and the first gamma lookup table, and may further generate fourth output image data based on fourth input image data and a third gamma lookup table. The display panel may operate based on the third output image data during a third duration subsequent to the second duration, and may operate based on the fourth output image data during a fourth duration subsequent to the third duration. The third gamma lookup table may correspond to the first region of the display panel, and a luminance of an image based on the third gamma lookup table may be different from the luminance of the image based on the first gamma lookup table and the luminance of the image based on the second gamma lookup table.

In an exemplary embodiment, the luminance of the image based on the first gamma lookup table may be lower than the luminance of the image based on the second gamma lookup table, and may be higher than the luminance of the image based on the third gamma lookup table.

In an exemplary embodiment, a length of at least one of the first duration and the second duration may be variable.

In an exemplary embodiment, the timing controller may determine a type of a first image displayed on the display panel based on the first output image data and the second output image data, and may change the length of the at least one of the first duration and the second duration based on the type of the first image.

In an exemplary embodiment, the timing controller may increase the length of the at least one of the first duration and the second duration when the first image corresponds to a dynamic image, and may decrease the length of the at least one of the first duration and the second duration when the first image corresponds to a static image.

In an exemplary embodiment, the timing controller may change the length of the at least one of the first duration and the second duration based on a flag signal indicating a type of an image displayed on the display panel.

According to an exemplary embodiment, in a method of operating a display apparatus, first output image data is generated based on first input image data and a first gamma lookup table. Second output image data is generated based on second input image data and a second gamma lookup table. A display panel in the display apparatus operates based on the first output image data during a first duration. The display panel operates based on the second output image data during a second duration subsequent to the first duration. The first and second gamma lookup tables correspond to a first region of the display panel, and a luminance of an image based on the first gamma lookup table is different from a luminance of an image based on the second gamma lookup table.

In an exemplary embodiment, a temporal smoothing operation may be further performed to reduce discontinuity between the first output image data and the second output image data during a third duration between the first duration and the second duration.

At least one smoothing image data may be generated by performing an interpolation based on the first output image data and the second output image data. The display panel may operate based on the at least one smoothing image data during the third duration.

In an exemplary embodiment, third output image data may be generated based on third input image data and a third gamma lookup table. Fourth output image data may be generated based on fourth input image data and one of the third gamma lookup table and a fourth gamma lookup table. The display panel may operate based on the third output image data during the first duration. The display panel may operate based on the fourth output image data during the second duration. The third and fourth gamma lookup tables may correspond to a second region of the display panel, and a luminance of an image based on the third gamma lookup table may be different from the luminance of the image based on the first gamma lookup table and a luminance of an image based on the fourth gamma lookup table.

In an exemplary embodiment, third output image data may be generated based on third input image data and the first gamma lookup table. Fourth output image data may be generated based on fourth input image data and a third gamma lookup table. The display panel may operate based on the third output image data during a third duration subsequent to the second duration. The display panel may operate based on the fourth output image data during a fourth duration subsequent to the third duration. The third gamma lookup table may correspond to the first region of the display panel, and a luminance of an image based on the third gamma lookup table may be different from the luminance of the image based on the first gamma lookup table and the luminance of the image based on the second gamma lookup table.

In an exemplary embodiment, a length of at least one of the first duration and the second duration may be further changed based on a type of an image displayed on the display panel based on the first output image data and the second output image data.

An exemplary embodiment display timing controller includes a gamma compensator configured to provide a plurality of output data sets for a corresponding plurality of successive time lapse periods based on a corresponding plurality of input data sets, respectively, and a plurality of gamma function sets, wherein each ordered element of each set corresponds to a like-ordered image display area, respectively.

An exemplary embodiment display timing controller further includes a temporal smoother configured to provide a plurality of temporally smoothed data sets, each temporally smoothed data set to be displayed between successive output data sets corresponding to successive time lapse periods, respectively.

In an exemplary embodiment display timing controller, each of the plurality of temporally smoothed data sets is based on at least an immediately preceding output data set and an immediately succeeding output data set.

In an exemplary embodiment display timing controller, each of the plurality of gamma function sets comprises different gamma functions corresponding to different display areas, respectively, for at least one time lapse period.

In an exemplary embodiment display timing controller, each of the plurality of gamma function sets comprises different gamma functions for a periodically repeating subset of the plurality of time lapse periods, respectively.

In an exemplary embodiment display timing controller, each of the plurality of gamma function sets comprises different gamma functions corresponding to different display areas, respectively, and each pair of the plurality of gamma function sets comprises same-ordered different gamma functions corresponding to different time lapse periods, respectively.

In an exemplary embodiment display timing controller, at least one gamma function of each of the plurality of gamma function sets is implemented with a stored gamma lookup table.

In an exemplary embodiment display timing controller, the same-ordered gamma functions of the plurality of gamma function sets corresponding to a same-ordered display area indicate a plurality of different luminances corresponding to periodically repeating pluralities of time lapse periods, respectively.

In an exemplary embodiment display timing controller, each of a first plurality of gamma function sets is periodically applied once per first plurality of time lapse periods, wherein a next of the first plurality of gamma function sets is periodically applied in the next of the first plurality of time lapse periods with a luminance different from the preceding gamma function set.

In an exemplary embodiment display timing controller, the gamma compensator is configured to use a temporal local digital asymmetric gamma (L-DAG) driving scheme to select one of the plurality of gamma function sets during at least one of the plurality of time lapse periods depending on both a location of the display region and a lapse of driving time.

In an exemplary embodiment display timing controller, the gamma compensator compensates gamma variations depending on a location of a display region, the compensated gamma variations decrease a residual DC voltage in a display panel before the residual DC voltage is saturated, and an afterimage is substantially prevented.

Thus, the display apparatus according to the present inventive concept may operate based on the temporal local digital asymmetric gamma (L-DAG) driving scheme where different gamma lookup tables are used depending on both a location of the display region and a lapse of driving time. Accordingly, gamma variations depending on the location of the display region may be reduced, the residual DC voltage in the display panel may decrease before the residual DC voltage is saturated, and an afterimage or an image sticking in the display panel may be reduced.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION

Figure 1:
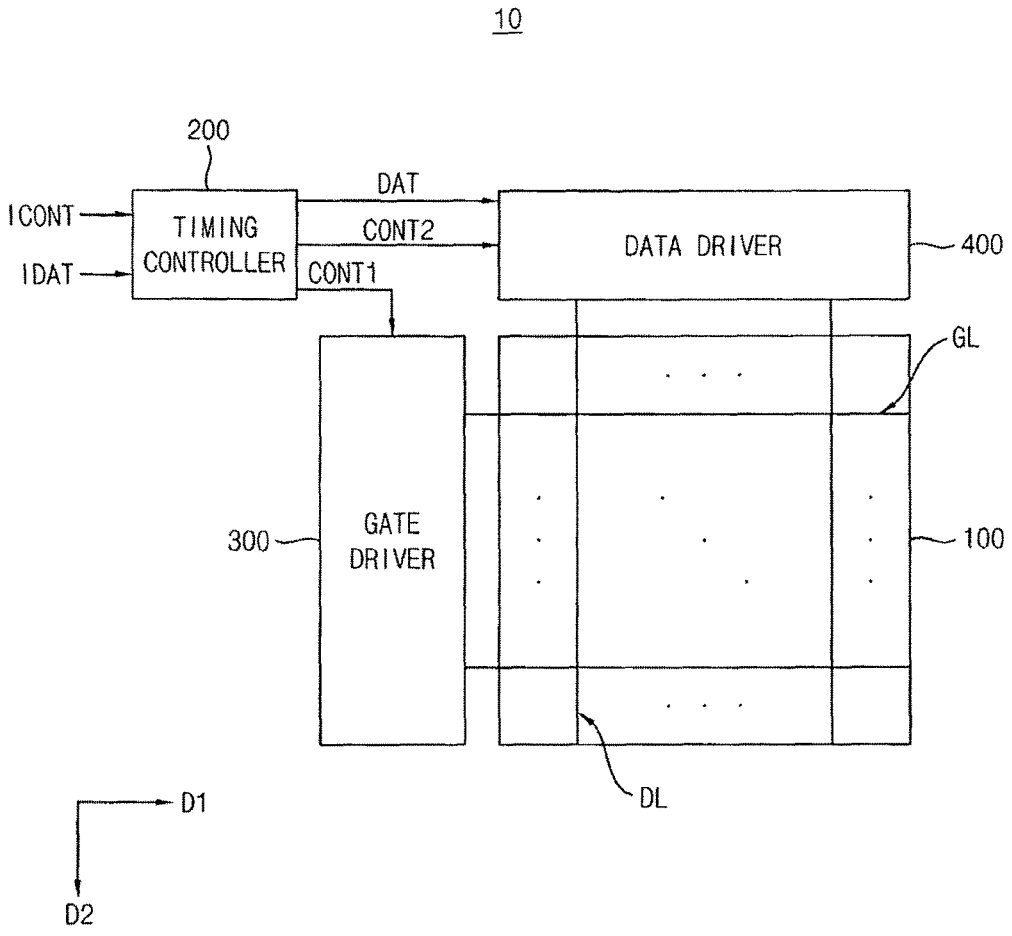
FIG. 1 is a schematic block diagram illustrating a display apparatus according to an exemplary embodiment.

The present inventive concept will be described more fully with reference to the accompanying drawings, in which exemplary embodiments are shown. This inventive concept may, however, be embodied in many different forms and should not be construed as limited to the embodiments set forth herein. Like reference numerals may refer to like elements throughout this application.

Figure 2:
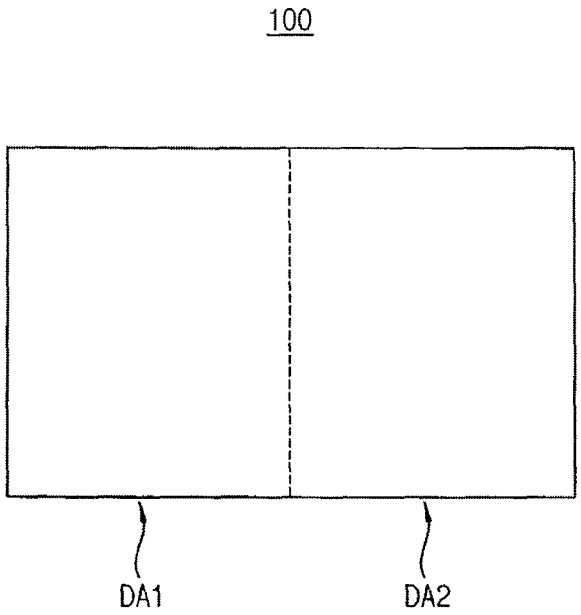
FIG. 2 is a schematic diagram illustrating a display panel included in the display apparatus according to an exemplary embodiment.

FIG. 1 is a block diagram illustrating a display apparatus according to an exemplary embodiment. FIG. 2 is a diagram illustrating a display panel included in the display apparatus according to an exemplary embodiment.

Referring to FIGS. 1 and 2, a display apparatus 10 includes a display panel 100, a timing controller 200, a gate driver 300 connected between the timing controller and the display panel, and a data driver 400 connected between the timing controller and the display panel.

The display panel 100 operates (e.g., displays an image) based on output image data DAT. The display panel 100 is connected to a plurality of gate lines GL from the gate driver and a plurality of data lines DL from the data driver. The gate lines GL may extend in a first direction D1, and the data lines DL may extend in a second direction D2 crossing (e.g., substantially perpendicular to) the first direction D1. The display panel 100 may include a plurality of pixels (not illustrated) that are arranged in a matrix form. Each pixel may be electrically connected to a respective one of the gate lines GL and a respective one of the data lines DL.

In an exemplary embodiment, the display panel 100 may be divided into a plurality of display regions. For example, as illustrated in FIG. 2, the display panel 100 may include a first display region DA1 and a second display region DA2. For another example, although not illustrated in FIG. 2, the display panel 100 may include M*N display regions where each of M and N is a natural number.

The timing controller 200 controls an operation of the display panel 100 and controls operations of the gate driver 300 and the data driver 400. The timing controller 200 receives input image data IDAT and an input control signal ICONT from an external device (e.g., a host or a graphics processor). The input image data IDAT may include a plurality of input pixel data for the plurality of pixels. The input control signal ICONT may include a master clock signal, a data enable signal, a vertical synchronization signal, a horizontal synchronization signal, etc.

The timing controller 200 generates the output image data DAT based on the input image data IDAT. The timing controller 200 generates a first control signal CONT1 based on the input control signal ICONT. The first control signal CONT1 may be provided to the gate driver 300, and a driving timing of the gate driver 300 may be controlled based on the first control signal CONT1. The first control signal CONT1 may include a vertical start signal, a gate clock signal, etc. The timing controller 200 generates a second control signal CONT2 based on the input control signal ICONT. The second control signal CONT2 may be provided to the data driver 400, and a driving timing of the data driver 400 may be controlled based on the second control signal CONT2. The second control signal CONT2 may include a horizontal start signal, a data clock signal, a data load signal, a polarity control signal, etc.

The gate driver 300 generates a plurality of gate signals for driving the gate lines GL based on the first control signal CONT1. The gate driver 300 may sequentially apply the gate signals to the gate lines GL. For example, the gate driver 300 may include a plurality of shift registers (not illustrated).

The data driver 400 generates a plurality of analog data voltages based on the second control signal CONT2 and the digital output image data DAT. The data driver 400 may sequentially apply the data voltages to the data lines DL. For example, the data driver 400 may include a shift register (not illustrated), a latch (not illustrated), a signal processor (not illustrated) and a buffer (not illustrated).

In an exemplary embodiment, the gate driver 300 and/or the data driver 400 may be disposed, such as directly mounted, on the display panel 100, or may be connected to the display panel 100 in a tape carrier package (TCP) type. Alternatively, the gate driver 300 and/or the data driver 400 may be integrated on the display panel 100.

The display apparatus 10 according to an exemplary embodiment may operate based on a local digital asymmetric gamma (L-DAG) driving scheme where different gamma lookup tables are used for different display regions among the plurality of display regions in the display panel 100. In addition, in the display apparatus 10 according to an exemplary embodiment, different gamma lookup tables may be used for a single display region at different times or by a lapse of driving time. The present inventive concept is not limited to the use of lookup tables to implement gamma functions, as some gamma functions may be implemented algebraically, for example, but without limitation. A hybrid driving scheme where different gamma functions or gamma lookup tables are used in the display apparatus 10 depending on both a location of the display region and a lapse of driving time may be referred to herein as a temporal L-DAG driving scheme.

Hereinafter, the temporal L-DAG driving scheme according to an exemplary embodiment will be described based on an example where the display panel 100 includes at least two display regions DA1 and DA2.

Figure 3:
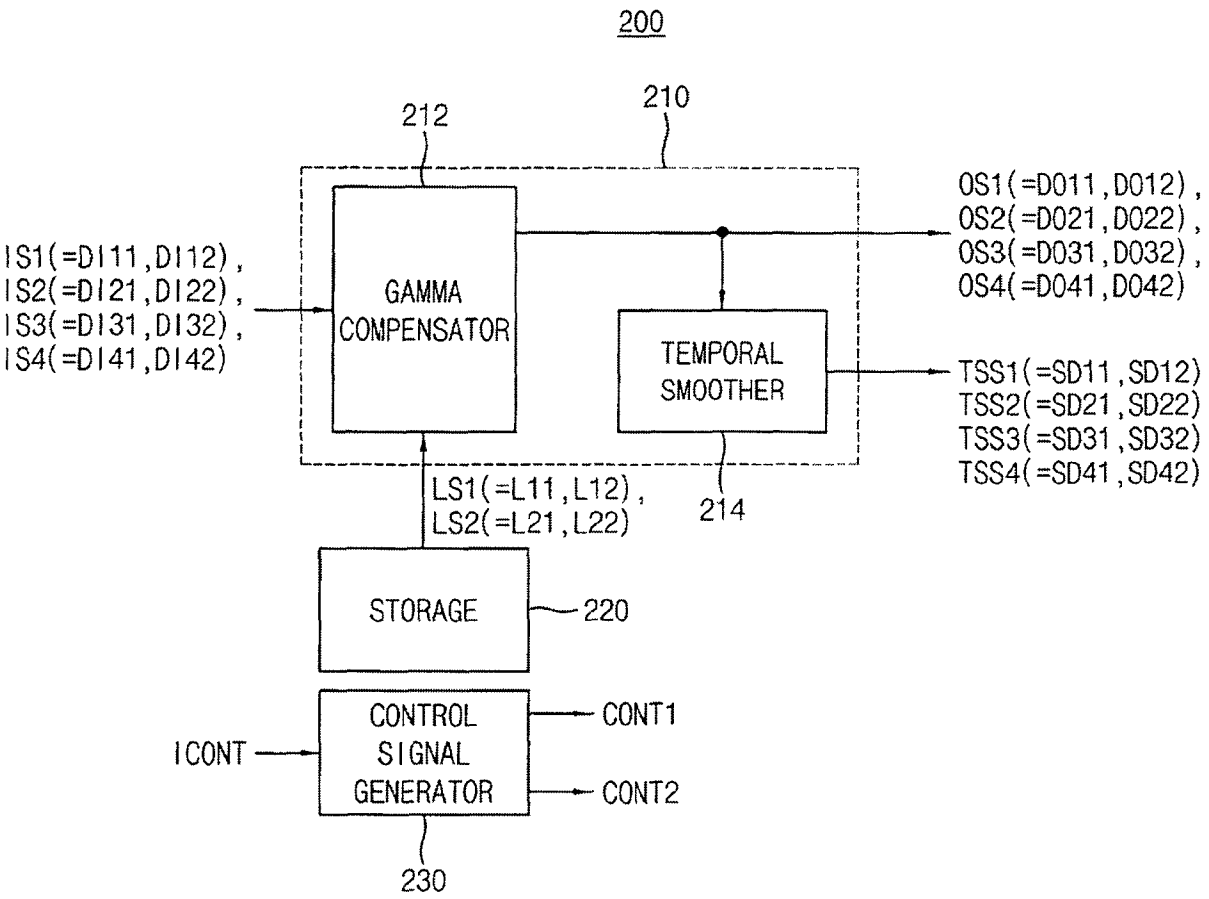
FIG. 3 is a schematic block diagram illustrating a timing controller included in the display apparatus according to an exemplary embodiment.

FIG. 3 is a block diagram illustrating a timing controller included in the display apparatus according to an exemplary embodiment.

Referring to FIGS. 2 and 3, a timing controller 200 may include an image processor 210, storage 220 connected to the image processor, and a control signal generator 230. The timing controller 200 is illustrated in FIG. 3 as being physically divided into multiple elements for convenience of explanation, however, the timing controller 200 need not be physically divided.

The image processor 210 includes a gamma compensator 212, which may be connected to a temporal smoother 214. The gamma compensator 212 may generate a plurality of output image data DO11, DO12, DO21, DO22, DO31, DO32, DO41 and DO42 based on a plurality of input image data DI11, DI12, DI21, DI22, DI31, DI32, DI41 and DI42 and a plurality of gamma lookup tables L11, L12, L21 and L22. The temporal smoother 214 may generate a plurality of smoothing image data SD11, SD12, SD21, SD22, SD31, SD32, SD41 and SD42 based on the plurality of output image data DO11~DO42.

The input image data DI11, DI21, DI31 and DI41, the output image data DO11, DO21, DO31 and DO41, and the smoothing image data SD11, SD21, SD31 and SD41 may be data for displaying an image (e.g., a first partial image) on the first display region DA1 of the display panel 100. The input image data DI12, DI22, DI32 and DI42, the output image data DO12, DO22, DO32 and DO42, and the smoothing image data SD12, SD22, SD32 and SD42 may be data for displaying an image (e.g., a second partial image) on the second display region DA2 of the display panel 100.

The plurality of input image data DI11~DI42 may be divided into four input image data sets IS1, IS2, IS3 and IS4. The first input image data set IS1 may include the first input image data DM and the second input image data DI12. The second input image data set IS2 may include the third input image data DI21 and the fourth input image data DI22. The third input image data set IS3 may include the fifth input image data DI31 and the sixth input image data DI32. The fourth input image data set IS4 may include the seventh input image data DI41 and the eighth input image data DI42.

Similarly, the plurality of output image data DO11~DO42 and the plurality of smoothing image data SD11~SD42 may be divided into four output image data sets OS1, OS2, OS3 and OS4 and four smoothing image data sets TSS1, TSS2, TSS3 and TSS4, respectively. The first output image data set OS1 may include the first output image data DO11 and the second output image data DO12. The second output image data set OS2 may include the third output image data DO21 and the fourth output image data DO22. The third output image data set OS3 may include the fifth output image data DO31 and the sixth output image data DO32. The fourth output image data set OS4 may include the seventh output image data DO41 and the eighth output image data DO42. The first smoothing image data set TSS1 may include the first smoothing image data SD11 and the second smoothing image data SD12. The second smoothing image data set TSS2 may include the third smoothing image data SD21 and the fourth smoothing image data SD22. The third smoothing image data set TSS3 may include the fifth smoothing image data SD31 and the sixth smoothing image data SD32. The fourth smoothing image data set TSS4 may include the seventh smoothing image data SD41 and the eighth smoothing image data SD42.

Each of the input image data sets IS1~IS4 and each of the output image data sets OS1~OS4 may be data for displaying an image on the display panel 100 during a respective one driving duration. For example, the first input image data set IS1 and the first output image data set OS1 may be data for displaying an image (e.g., at least one frame) on the display panel 100 during a first driving duration (e.g., DP1 in FIG. 5). The second input image data set IS2 and the second output image data set OS2 may be data for displaying an image on the display panel 100 during a second driving duration (e.g., DP2 in FIG. 5) subsequent to the first driving duration. The third input image data set IS3 and the third output image data set OS3 may be data for displaying an image on the display panel 100 during a third driving duration (e.g., DP3 in FIG. 5) subsequent to the second driving duration. The fourth input image data set IS4 and the fourth output image data set OS4 may be data for displaying an image on the display panel 100 during a fourth driving duration (e.g., DP4 in FIG. 5) subsequent to the third driving duration.

Each of the smoothing image data sets TSS1~TSS4 may be data for reducing discontinuity between two consecutive images during a respective one smoothing duration. For example, the first smoothing image data set TSS1 may be data for reducing discontinuity between the first output image data set OS1 and the second output image data set OS2 during a first smoothing duration (e.g., SP1 in FIG. 5) between the first driving duration and the second driving duration. The second smoothing image data set TSS2 may be data for reducing discontinuity between the second output image data set OS2 and the third output image data set OS3 during a second smoothing duration (e.g., SP2 in FIG. 5) between the second driving duration and the third driving duration. The third smoothing image data set TSS3 may be data for reducing discontinuity between the third output image data set OS3 and the fourth output image data set OS4 during a third smoothing duration (e.g., SP3 in FIG. 5) between the third driving duration and the fourth driving duration. The fourth smoothing image data set TSS4 may be data for reducing discontinuity between the fourth output image data set OS4 and fifth output image data set corresponding to a fifth driving duration during a fourth smoothing duration (e.g., SP4 in FIG. 5) between the fourth driving duration and the fifth driving duration.

Although not illustrated in FIG. 3, the image processor 210 may further include an element that selectively performs an image quality compensation, a spot compensation, an adaptive color correction (ACC), and/or a dynamic capacitance compensation (DCC) on the plurality of input image data DI11~DI42.

The storage 220 may store the plurality of gamma lookup tables L11~L22. In an exemplary embodiment, the storage 220 may include, for example, at least one nonvolatile memory such as an erasable programmable read-only memory (EPROM), an electrically erasable programmable read-only memory (EEPROM), a flash memory, a phase change random access memory (PRAM), a resistance random access memory (RRAM), a magnetic random access memory (MRAM), a ferroelectric random access memory (FRAM), a nano floating gate memory (NFGM), a polymer random access memory (PoRAM), etc. In an exemplary embodiment, the storage 220 may be disposed outside the timing controller 200.

The first and third gamma lookup tables L11 and L21 may correspond to the first display region DA1 of the display panel 100. The second and fourth gamma lookup tables L12 and L22 may correspond to the second display region DA2 of the display panel 100. In other words, the first and third gamma lookup tables L11 and L21 may be used for displaying the image on the first display region DA1 of the display panel 100, and the second and fourth gamma lookup tables L12 and L22 may be used for displaying the image on the second display region DA2 of the display panel 100.

The plurality of gamma lookup tables L11~L22 may be divided into two gamma lookup table sets LS1 and LS2. The first gamma lookup table set LS1 may include the first and second gamma lookup tables L11 and L12. The second gamma lookup table set LS2 may include the third and fourth gamma lookup tables L21 and L22.

In an exemplary embodiment, the first gamma lookup table L11 may include gamma data different from that of the second gamma lookup table L12. The gamma data of the first gamma lookup table L11 may also be different from that of the third gamma lookup table L21. Similarly, the third gamma lookup table L21 may include gamma data different from that of the fourth gamma lookup table L22.

The control signal generator 230 may receive the input control signal ICONT. The control signal generator 230 may generate the first control signal CONT1 for the gate driver 300 and the second control signal CONT2 for the data driver 400 based on the input control signal ICONT. The control signal generator 230 may output the first control signal CONT1 to the gate driver 300 and may output the second control signal CONT2 to the data driver 400.

Figure 4:
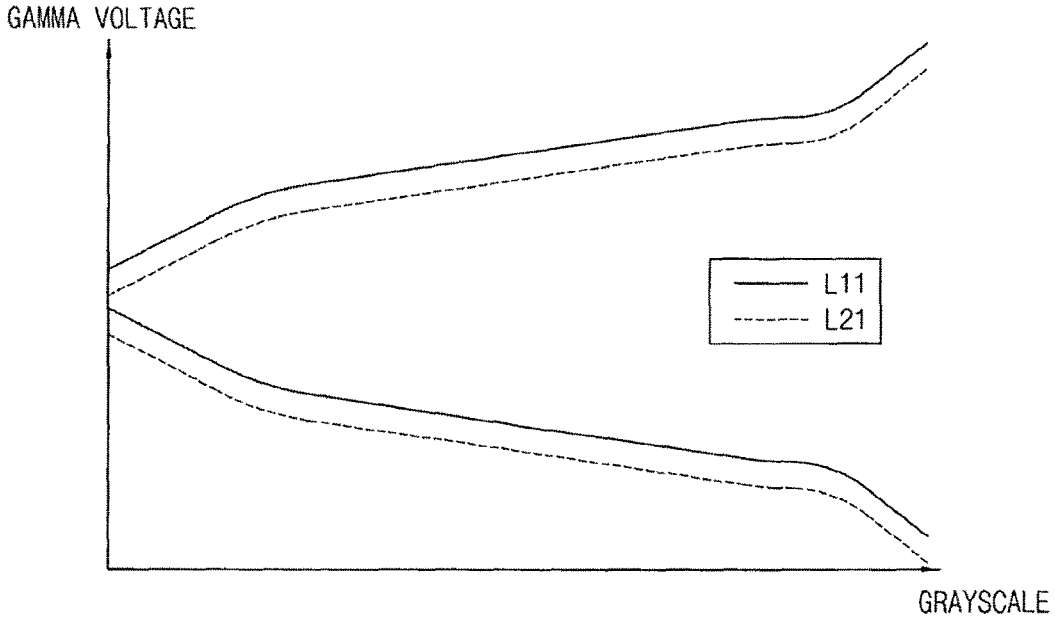
FIGS. 4, 5 and 6 are graphical diagrams for describing an operation of the display apparatus according to an exemplary embodiment.
Figure 5:
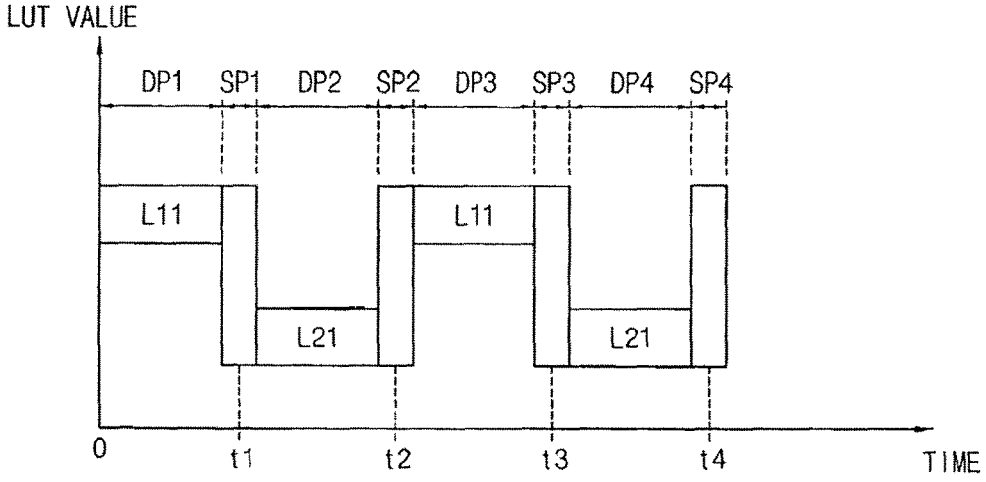
Figure 6:
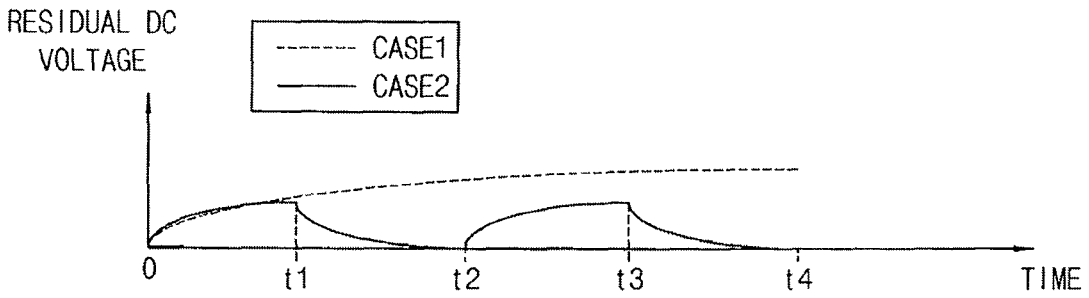

FIGS. 4, 5 and 6 are diagrams for describing an operation of the display apparatus according to an exemplary embodiment. FIG. 4 is a graph illustrating an example of the gamma lookup tables stored in the storage 220 in FIG. 3. FIG. 5 is a diagram illustrating an example of the temporal L-DAG driving scheme based on the gamma lookup tables in FIG. 4. FIG. 6 is a diagram illustrating a change of a residual direct current (DC) voltage in the display panel 100 when the display apparatus 10 operates based on the temporal L-DAG driving scheme in FIG. 5.

Referring to FIGS. 3 and 4, a level of a gamma voltage generated based on the first gamma lookup table L11 may be higher than a level of a gamma voltage generated based on the third gamma lookup table L21. In other words, a luminance of an image based on the first gamma lookup table L11 may be higher than a luminance of an image based on the third gamma lookup table L21, and the gamma data of the first gamma lookup table L11 may be greater than the gamma data of the third gamma lookup table L21. The present inventive concept is not limited to a preceding image being brighter than a succeeding image, as the brighter image may come later, or more than two images of differing luminances based on more than two gamma function sets may be displayed in sequence, for example, without limitation.

Although not illustrated in FIG. 4, a relationship between the second gamma lookup table L12 and the fourth gamma lookup table L22 may be substantially the same as a relationship between the first gamma lookup table L11 and the third gamma lookup table L21. In other words, a luminance of an image based on the second gamma lookup table L12 may be higher than a luminance of an image based on the fourth gamma lookup table L22.

Referring to FIGS. 2, 3, 5 and 6, the image processor 210 may perform image processing for the temporal L-DAG driving scheme, and the display panel 100 may operate (e.g., may display an image) based on image data outputted from the image processor 210.

First of all, an operation of the display apparatus 10 for the first display region DA1 of the display panel 100 will be described in detail.

The first output image data DO11 for a first driving duration DP1 and the fifth output image data DO31 for a third driving duration DP3 may be generated based on the first gamma lookup table L11. The third output image data DO21 for a second driving duration DP2 and the seventh output image data DO41 for a fourth driving duration DP4 may be generated based on the third gamma lookup table L21.

For example, the gamma compensator 212 may generate the first output image data DO11 based on the first input image data DI11 and the first gamma lookup table L11, may generate the third output image data DO21 based on the third input image data DI21 and the third gamma lookup table L21, may generate the fifth output image data DO31 based on the fifth input image data DI31 and the first gamma lookup table L11, and may generate the seventh output image data DO41 based on the seventh input image data DI41 and the third gamma lookup table L21.

The first display region DA1 of the display panel 100 may operate based on the first output image data DO11, the third output image data DO21, the fifth output image data DO31 and the seventh output image data DO41. For example, the display panel 100 may display an image on the first display region DA1 based on the first output image data DO11 during the first driving duration DP1, may display an image on the first display region DA1 based on the third output image data DO21 during the second driving duration DP2, may display an image on the first display region DA1 based on the fifth output image data DO31 during the third driving duration DP3, and may display an image on the first display region DA1 based on the seventh output image data DO41 during the fourth driving duration DP4.

A temporal smoothing operation for the first display region DA1 may be performed to reduce discontinuity between two consecutive output image data during a smoothing duration (e.g., one of SP1, SP2, SP3 and SP4) between two consecutive driving durations.

For example, the temporal smoother 214 may generate the first smoothing image data SD11 by performing an interpolation based on the first output image data DO11 and the third output image data DO21, may generate the third smoothing image data SD21 by performing the interpolation based on the third output image data DO21 and the fifth output image data DO31, and may generate the fifth smoothing image data SD31 by performing the interpolation based on the fifth output image data DO31 and the seventh output image data DO41. In addition, the temporal smoother 214 may generate the seventh smoothing image data SD41 by performing the interpolation based on the seventh output image data DO41 and ninth output image data corresponding to the first display region DA1 and a fifth driving duration subsequent to the fourth driving duration DP4.

Each of the smoothing image data SD11, SD21, SD31 and SD41 may have at least one value for preventing a drastic change of the output image data (e.g., for a buffering function). For example, the first smoothing image data SD11 may have a middle value of the first output image data DO11 and the third output image data DO21. For another example, the first smoothing image data SD11 may have a first value that is between the first output image data DO11 and the third output image data DO21, and a second value that is greater than the first value and is between the first output image data DO11 and the third output image data DO21.

The first display region DA1 of the display panel 100 may operate based on the first smoothing image data SD11, the third smoothing image data SD21, the fifth smoothing image data SD31 and the seventh smoothing image data SD41. For example, the display panel 100 may display an image on the first display region DA1 based on the first smoothing image data SD11 during a first smoothing duration SP1, may display an image on the first display region DA1 based on the third smoothing image data SD21 during a second smoothing duration SP2, may display an image on the first display region DA1 based on the fifth smoothing image data SD31 during a third smoothing duration SP3, and may display an image on the first display region DA1 based on the seventh smoothing image data SD41 during a fourth smoothing duration SP4.

In FIG. 6, CASE1 may represent an example of a conventional display apparatus where a gamma lookup table for operating a display panel is fixed, and CASE2 may represent an example of the display apparatus 10 according to an exemplary embodiment where the gamma lookup tables for operating the display panel 100 are changed by a lapse of time. In CASE1, a residual DC voltage in the display panel may continuously or asymptotically increase by a lapse of time. However, in CASE2, a residual DC voltage in the display panel 100 (e.g., in the first display region DA1) may increase or may decrease by a lapse of time. For example, the residual DC voltage in the display panel 100 may increase from time 0 to time t1 (or from time t2 to time t3), during which the first gamma lookup table L11 having a relatively great value is used for operating the display panel 100. The residual DC voltage in the display panel 100 may decrease from time t1 to time t2 (or from time t3 to time t4), during which the third gamma lookup table L21 having a relatively small value is used for operating the display panel 100.

Next, an operation of the display apparatus 10 for the second display region DA2 of the display panel 100 will be described in detail.

According to an exemplary embodiment, the temporal L-DAG driving scheme may be entirely or partially employed on the display panel 100. In other words, the operation of the display apparatus 10 for the second display region DA2 of the display panel 100 may be substantially the same as or different from the operation of the display apparatus 10 for the first display region DA1 of the display panel 100.

The second output image data DO12 for the first driving duration DP1 and the sixth output image data DO32 for the third driving duration DP3 may be generated based on the second gamma lookup table L12. The fourth output image data DO22 for the second driving duration DP2 and the eighth output image data DO42 for the fourth driving duration DP4 may be generated based on one of the second gamma lookup table L12 and the fourth gamma lookup table L22.

For example, the gamma compensator 212 may generate the second output image data DO12 based on the second input image data DI12 and the second gamma lookup table L12, and may generate the sixth output image data DO32 based on the sixth input image data DI32 and the second gamma lookup table L12. The gamma compensator 212 may generate the fourth output image data DO22 based on the fourth input image data DI22 and one of the second and fourth gamma lookup tables L12 and L22, and may generate the eighth output image data DO42 based on the eighth input image data DI42 and one of the second and fourth gamma lookup tables L12 and L22.

The display panel 100 may display an image on the second display region DA2 based on the second output image data DO12 during the first driving duration DP1, based on the fourth output image data DO22 during the second driving duration DP2, based on the sixth output image data DO32 during the third driving duration DP3, and based on the eighth output image data DO42 during the fourth driving duration DP4.

A temporal smoothing operation for the second display region DA2 may be performed to reduce discontinuity between two consecutive output image data during the smoothing duration.

For example, the temporal smoother 214 may generate the second smoothing image data SD12 by performing the interpolation based on the second output image data DO12 and the fourth output image data DO22, may generate the fourth smoothing image data SD22 by performing the interpolation based on the fourth output image data DO22 and the sixth output image data DO32, and may generate the sixth smoothing image data SD32 by performing the interpolation based on the sixth output image data DO32 and the eighth output image data DO42. In addition, the temporal smoother 214 may generate the eighth smoothing image data SD42 by performing the interpolation based on the eighth output image data DO42 and tenth output image data corresponding to the second display region DA2 and the fifth driving duration.

The display panel 100 may display an image on the second display region DA2 based on the second smoothing image data SD12 during the first smoothing duration SP1, based on the fourth smoothing image data SD22 during the second smoothing duration SP2, based on the sixth smoothing image data SD32 during the third smoothing duration SP3, and based on the eighth smoothing image data SD42 during the fourth smoothing duration SP4.

In an exemplary embodiment, at least a part of the temporal smoothing operation may be omitted. For example, when the temporal L-DAG driving scheme is partially employed on the display panel 100 (e.g., on the first display region DA1), the temporal smoothing operation for the second display region DA2 may be omitted. For example, when the fourth output image data DO22 is generated based on the second gamma lookup table L12, e.g., when all of the output image data DO12, DO22 and DO32 for the driving durations DP1, DP2 and DP3 are generated based on the second gamma lookup table L12, the temporal smoothing operation for the second display region DA2 may be omitted during the first and second smoothing durations SP1 and SP2.

In an exemplary embodiment, a spatial smoothing operation may be further performed to reduce discontinuity in a boundary region between the first display region DA1 and the second display region DA2. For example, the image processor 210 may further perform the spatial smoothing operation to reduce discontinuity between the first output image data DO11 and the second output image data DO12 during the first driving duration DP1. Similarly, the image processor 210 may further perform the spatial smoothing operation to reduce discontinuity between each of the output image data DO21, DO31 and DO41 and a respective one of the output image data DO22, DO32 and DO42 during the driving durations DP2, DP3 and DP4, and may further perform the spatial smoothing operation to reduce discontinuity between each of the smoothing image data SD11, SD21, SD31 and SD41 and a respective one of the smoothing image data SD12, SD22, SD32 and SD42 during the smoothing durations SP1, SP2, SP3 and SP4.

In an exemplary embodiment, each of the driving durations DP1, DP2, DP3 and DP4 and each of the smoothing durations SP1, SP2, SP3 and SP4 may include at least one frame that indicates a time required to display one image frame on the display panel 100.

The display apparatus 10 according to an exemplary embodiment may operate based on the temporal L-DAG driving scheme where different gamma lookup tables are used depending on both a location of the display region and a lapse of driving time. Accordingly, gamma variations depending on the location of the display region may be reduced, the residual DC voltage in the display panel 100 may decrease before the residual DC voltage is saturated, and thus an afterimage or an image sticking in the display panel 100 may be reduced.

Figure 7:
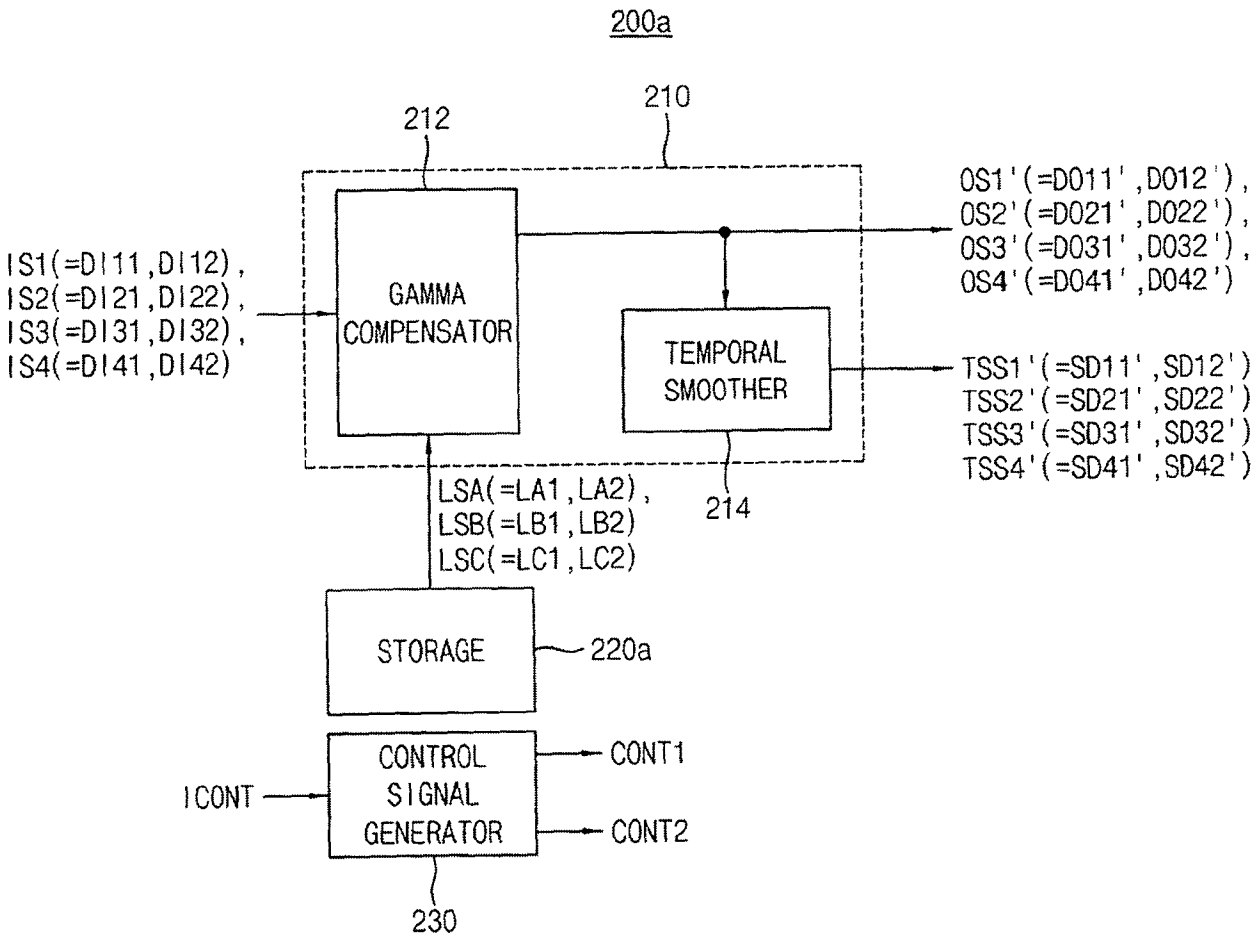
FIG. 7 is a schematic block diagram illustrating a timing controller included in the display apparatus according to an exemplary embodiment.

FIG. 7 is a block diagram illustrating a timing controller included in the display apparatus according to an exemplary embodiment.

Referring to FIGS. 2 and 7, a timing controller 200*a* may include an image processor 210, storage 220*a* and a control signal generator 230.

The timing controller 200*a* of FIG. 7 may be substantially the same as the timing controller 200 of FIG. 2, except that gamma lookup tables stored in the storage 220*a* are changed, and then image data generated by the image processor 210 are changed.

The image processor 210 may include a gamma compensator 212 and a temporal smoother 214. The gamma compensator 212 may generate a plurality of output image data DO11', DO12', DO21', DO22', DO31', DO32', DO41' and DO42' based on a plurality of input image data DI11, DI12, DI21, DI22, DI31, DI32, DI41 and DI42 and a plurality of gamma lookup tables LA1, LA2, LB1, LB2, LC1 and LC2. The temporal smoother 214 may generate a plurality of smoothing image data SD11', SD12', SD21', SD22', SD31', SD32', SD41' and SD42' based on the plurality of output image data DO11'~DO42'.

The input image data DI11, DI21, DI31 and DI41, the output image data DO11', DO21', DO31' and DO41', and the smoothing image data SD11', SD21', SD31' and SD41' may be data for displaying an image on the first display region DA1 of the display panel 100. The input image data DI12, DI22, DI32 and DI42, the output image data DO12', DO22', DO32' and DO42', and the smoothing image data SD12', SD22', SD32' and SD42' may be data for displaying an image on the second display region DA2 of the display panel 100.

The plurality of input image data DI11~DI42 may be divided into four input image data sets IS1, IS2, IS3 and IS4. Similarly, the plurality of output image data DO11'~DO42' and the plurality of smoothing image data SD11'~SD42' may be divided into four output image data sets OS1', OS2', OS3' and OS4' and four smoothing image data sets TSS1', TSS2', TSS3' and TSS4', respectively. Each of the input image data sets IS1~IS4 and each of the output image data sets OS1'~OS4' may be data for displaying an image on the display panel 100 during a respective one driving duration (e.g., DPA, DPB, DPC and DPD in FIG. 9). Each of the smoothing image data sets TSS1'~TSS4' may be data for reducing discontinuity between two consecutive images during a respective one smoothing duration (e.g., SPA, SPB, SPC and SPD in FIG. 9).

The storage 220 may store the plurality of gamma lookup tables LA1~LC2. The first, third and fifth gamma lookup tables LA1, LB1 and LC1 may correspond to the first display region DA1 of the display panel 100. The second, fourth and sixth gamma lookup tables LA2, LB2 and LC2 may correspond to the second display region DA2 of the display panel 100. The plurality of gamma lookup tables LA1~LC2 may be divided into three gamma lookup table sets LSA, LSB and LSC. The first gamma lookup table LA1 may include gamma data different from that of the second gamma lookup table LA2 and also different from those of the third and fifth gamma lookup tables LB1 and LC1.

Figure 8:
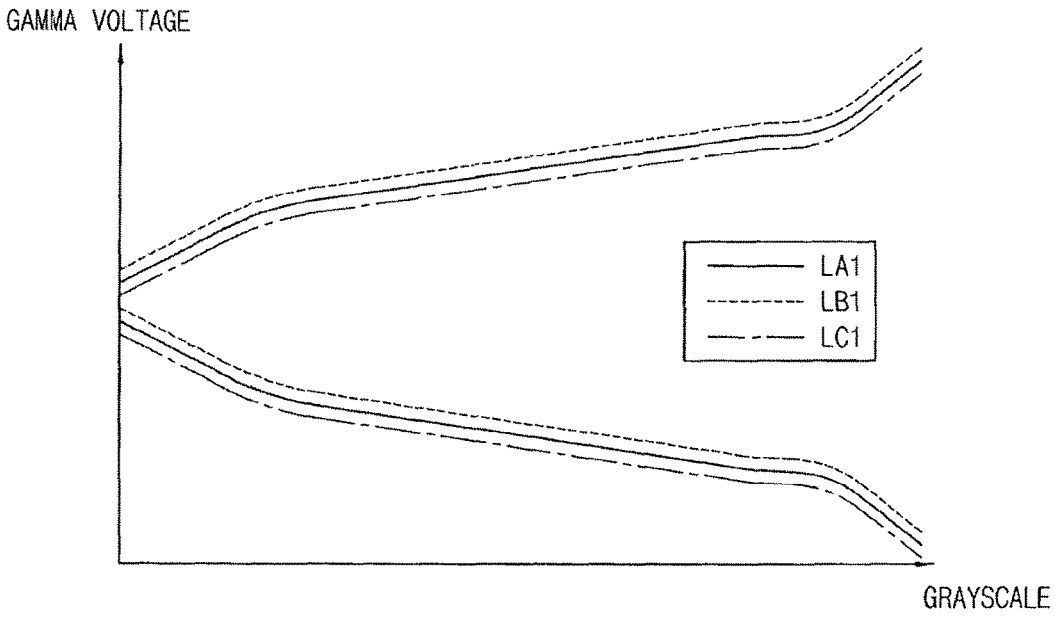
FIGS. 8 and 9 are graphical diagrams for describing an operation of the display apparatus according to an exemplary embodiment.
Figure 9:
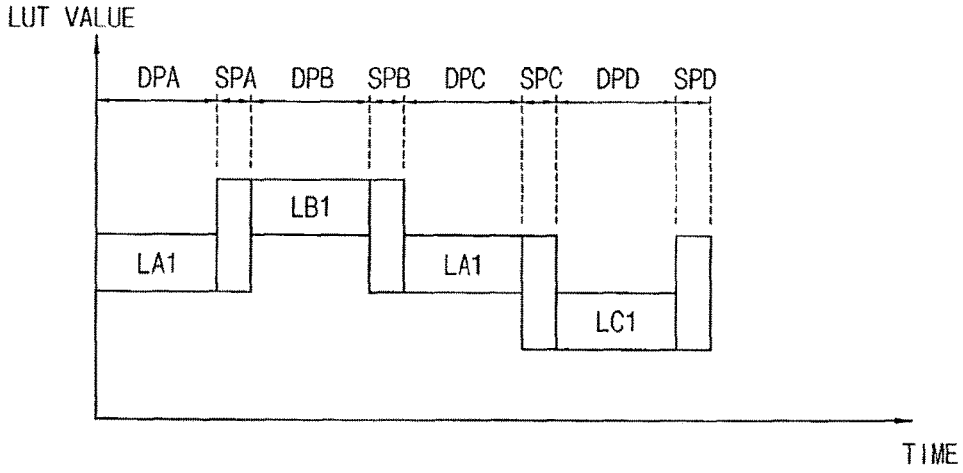

FIGS. 8 and 9 are diagrams for describing an operation of the display apparatus according to an exemplary embodiment. FIG. 8 is a graph illustrating an example of the gamma lookup tables stored in the storage 220*a* in FIG. 7. FIG. 9 is a diagram illustrating an example of the temporal L-DAG driving scheme based on the gamma lookup tables in FIG. 8.

Referring to FIGS. 7 and 8, a level of a gamma voltage generated based on the first gamma lookup table LA1 may be lower than a level of a gamma voltage generated based on the third gamma lookup table LB1, and may be higher than a level of a gamma voltage generated based on the fifth gamma lookup table LC1. In other words, a luminance of an image based on the first gamma lookup table LA1 may be lower than a luminance of an image based on the third gamma lookup table LB1, and may be higher than a luminance of an image based on the fifth gamma lookup table LC1. Although not illustrated in FIG. 8, a relationship between the gamma lookup tables LA2, LB2 and LC2 may be substantially the same as a relationship between the gamma lookup tables LA1, LB1 and LC1.

Referring to FIGS. 2, 7 and 9, the image processor 210 may perform an image processing for the temporal L-DAG driving scheme, and the display panel 100 may operate based on image data outputted from the image processor 210.

In an operation of the display apparatus 10 for the first display region DA1 of the display panel 100, the gamma compensator 212 may generate the first output image data DO11' based on the first input image data DM and the first gamma lookup table LA1, may generate the third output image data DO21' based on the third input image data DI21 and the third gamma lookup table LB1, may generate the fifth output image data DO31' based on the fifth input image data DI31 and the first gamma lookup table LA1, and may generate the seventh output image data DO41' based on the seventh input image data DI41 and the fifth gamma lookup table LC1.

The display panel 100 may display an image on the first display region DA1 based on the first output image data DO11' during a first driving duration DPA, based on the third output image data DO21' during a second driving duration DPB, based on the fifth output image data DO31' during a third driving duration DPC, and based on the seventh output image data DO41' during a fourth driving duration DPD.

The temporal smoothing operation for the first display region DA1 may be performed to reduce discontinuity between two consecutive output image data during the smoothing duration. For example, the temporal smoother 214 may generate the first smoothing image data SD11' by performing the interpolation based on the first output image data DO11' and the third output image data DO21', may generate the third smoothing image data SD21' by performing the interpolation based on the third output image data DO21' and the fifth output image data DO31', may generate the fifth smoothing image data SD31' by performing the interpolation based on the fifth output image data DO31' and the seventh output image data DO41', and may generate the seventh smoothing image data SD41' by performing the interpolation based on the seventh output image data DO41' and ninth output image data corresponding to the first display region DA1 and a fifth driving duration subsequent to the fourth driving duration DPD.

The display panel 100 may display an image on the first display region DA1 based on the first smoothing image data SD11' during a first smoothing duration SPA, based on the third smoothing image data SD21' during a second smoothing duration SPB, based on the fifth smoothing image data SD31' during a third smoothing duration SPC, and based on the seventh smoothing image data SD41' during a fourth smoothing duration SPD.

In an operation of the display apparatus 10 for the second display region DA2 of the display panel 100, the temporal L-DAG driving scheme may be entirely or partially employed on the display panel 100. In other words, the operation of the display apparatus 10 for the second display region DA2 of the display panel 100 may be substantially the same as or different from the operation of the display apparatus 10 for the first display region DA1 of the display panel 100. According to an exemplary embodiment, the temporal smoothing operation for the second display region DA2 may be selectively performed, and the spatial smoothing operation may be further performed to reduce discontinuity in a boundary region between the first display region DA1 and the second display region DA2.

Figure 10:
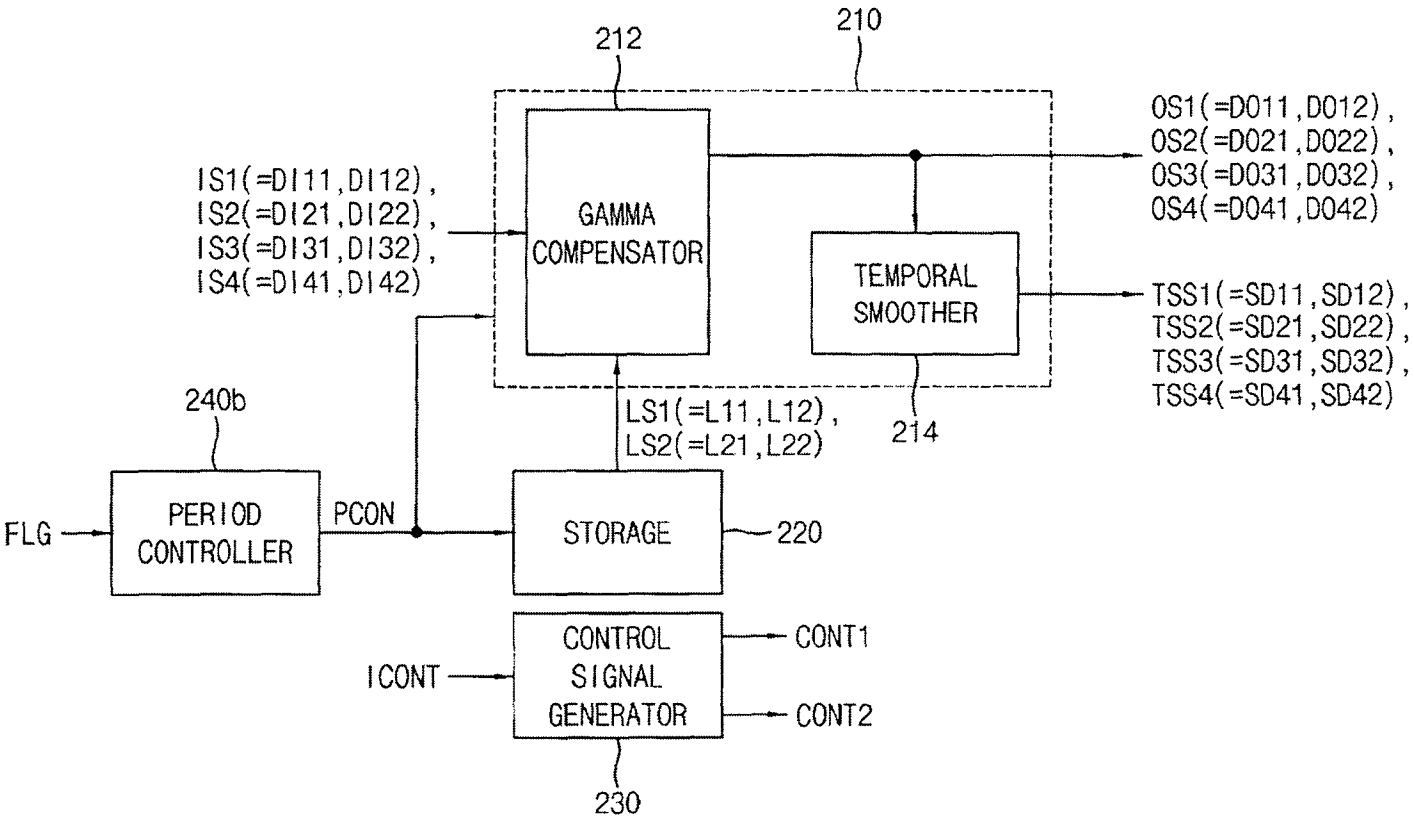
FIGS. 10 and 11 are schematic block diagrams illustrating a timing controller included in the display apparatus according to an exemplary embodiment.
Figure 11:
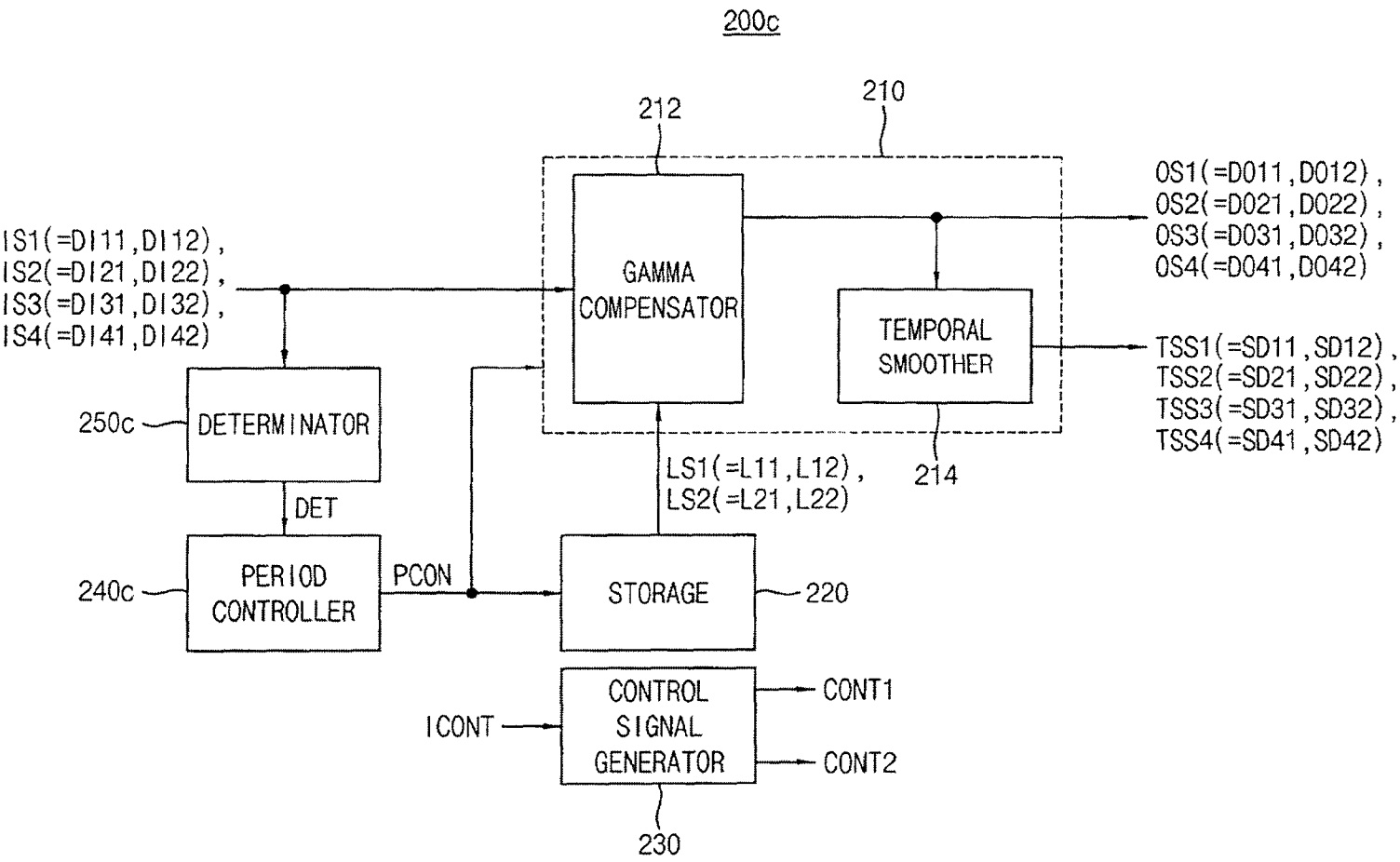

FIGS. 10 and 11 are block diagrams illustrating a timing controller included in the display apparatus according to an exemplary embodiment.

Referring to FIG. 10, a timing controller 200*b* may include an image processor 210, storage 220, a control signal generator 230 and a period controller 240*b*. Referring to FIG. 11, a timing controller 200*c* may include an image processor 210, storage 220, a control signal generator 230, a period controller 240*c* and a determinator 250*c*.

The timing controller 200*b* of FIG. 10 may be substantially the same as the timing controller 200 of FIG. 2, except that the timing controller 200*b* further includes the period controller 240*b*. The timing controller 200*c* of FIG. 11 may be substantially the same as the timing controller 200 of FIG. 2, except that the timing controller 200*c* further includes the period controller 240*c* and the determinator 250*c*.

In the display apparatus 10 according to an exemplary embodiment, a length of at least one of the driving durations (e.g., DP1, DP2, DP3 and DP4 in FIG. 5) and/or a length of at least one of the smoothing durations (e.g., SP1, SP2, SP3 and SP4 in FIG. 5) may be variable.

The timing controller 200*b* of FIG. 10 may change the length of the at least one of the driving durations and/or the length of the at least one of the smoothing durations based on a flag signal FLG that is received from an external device (e.g., a host or a graphic processor).

The period controller 240*b* in FIG. 10 may generate a period control signal PCON based on the flag signal FLG that indicates a type of an image displayed on the display panel 100.

The timing controller 200*c* of FIG. 11 may determine a type of an image displayed on the display panel 100 based on the input image data DI11~DI42, and may change the length of the at least one of the driving durations and/or the length of the at least one of the smoothing durations based on the type of the image.

The determinator 250*c* in FIG. 11 may generate a determination signal DET indicating the type of the image based on the input image data DI11~DI42. For example, the determinator 250*c* may compare image data for a previous frame with image data for a present frame to determine the type of the image, and may include a frame memory and/or a line memory. The period controller 240*c* in FIG. 11 may generate a period control signal PCON based on the determination signal DET.

In the examples of FIGS. 10 and 11, the period control signal PCON may be provided to the image processor 210 and the storage 220. The length of the at least one of the driving durations and/or the length of the at least one of the smoothing durations may be changed based on the period control signal PCON.

In an exemplary embodiment, when a static image (e.g., a still image, a stopped image, a photograph, etc.) is displayed on the display panel 100, the timing controller 200*b* or the timing controller 200*c* may decrease the length of the at least one of the driving durations and/or the length of the at least one of the smoothing durations may be changed based on the period control signal PCON. When a dynamic image (e.g., a moving image, a video, etc.) is displayed on the display panel 100, the timing controller 200*b* or the timing controller 200*c* may increase the length of the at least one of the driving durations and/or the length of the at least one of the smoothing durations may be changed based on the period control signal PCON.

In an exemplary embodiment, when the static image is displayed on the display panel 100, the timing controller 200*b* or the timing controller 200*c* may maintain the temporal L-DAG driving scheme based on the period control signal PCON. When a dynamic image (e.g., a moving image, a video, etc.) is displayed on the display panel 100, the timing controller 200*b* or the timing controller 200*c* may stop performing the temporal L-DAG driving scheme based on the period control signal PCON.

Figure 12:
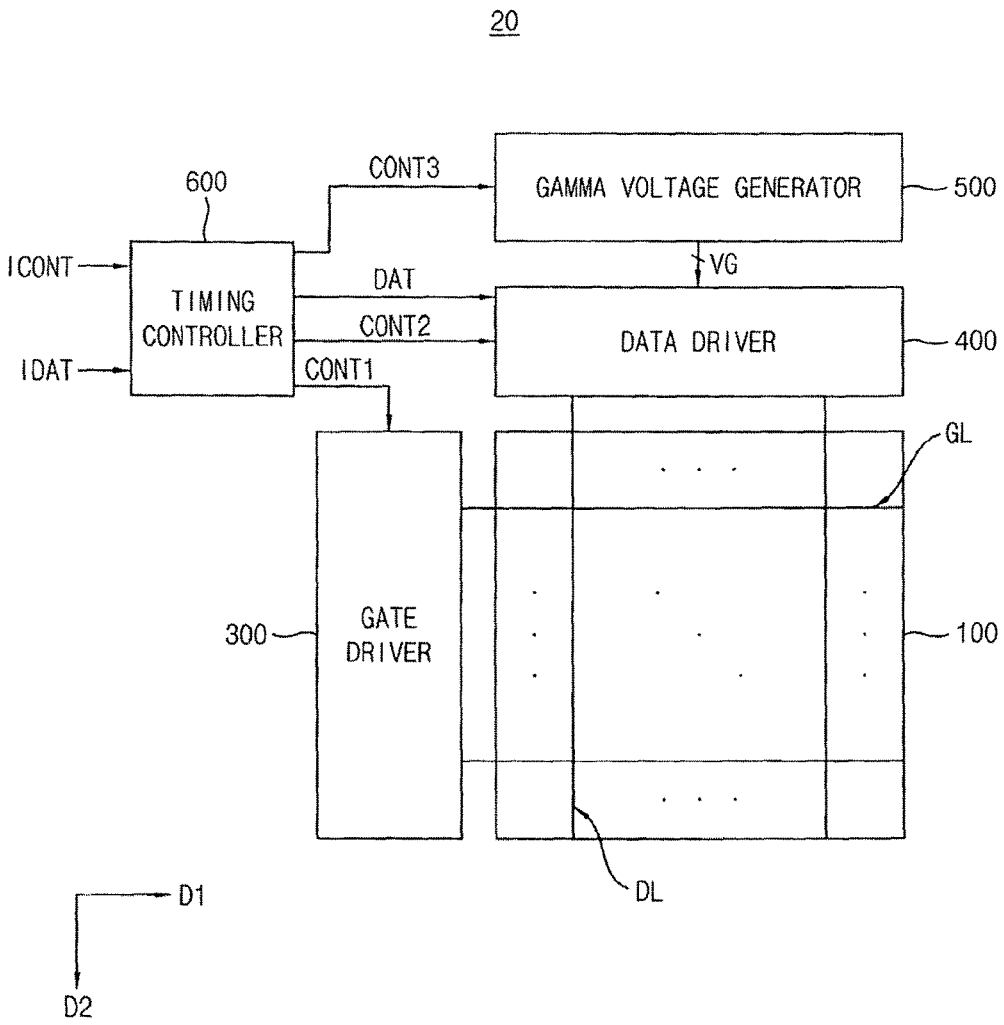
FIG. 12 is a schematic block diagram illustrating a display apparatus according to an exemplary embodiment.

FIG. 12 is a block diagram illustrating a display apparatus according to an exemplary embodiment.

Referring to FIG. 12, a display apparatus 20 includes a display panel 100, a timing controller 600, a gate driver 300 and a data driver 400. The display apparatus 20 may further include a gamma voltage generator 500.

The display apparatus 20 of FIG. 12 may be substantially the same as the display apparatus 10 of FIG. 1, except that the display apparatus 20 of FIG. 12 further includes the gamma voltage generator 500. In addition, the timing controller 600 in FIG. 12 may be partially different from the timing controller 200 in FIG. 1.

The timing controller 600 controls an operation of the display panel 100 and controls operations of the gate driver 300, the data driver 400 and the gamma voltage generator 500. The timing controller 600 generates output image data DAT, a first control signal CONT1, a second control signal CONT2 and a third control signal CONT3 based on input image data IDAT and an input control signal ICONT.

The gamma voltage generator 500 receives the third control signal CONT3 from the timing controller 600. The gamma voltage generator 500 generates gamma reference voltages VG based on the third control signal CONT3. To employ the temporal L-DAG driving scheme, different gamma lookup tables may be used for generating the gamma reference voltages VG depending on both a location of the display region and a lapse of driving time. The gamma lookup tables may be stored in the timing controller 600, the gamma voltage generator 500, and/or any storage (not illustrated).

Figure 13:
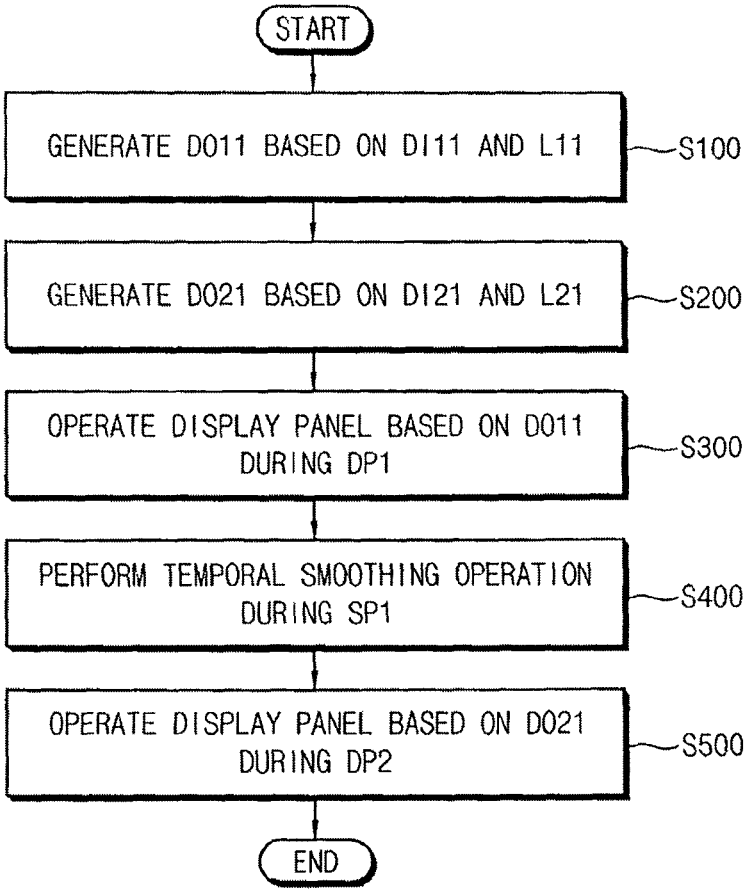
FIG. 13 is a flow chart diagram illustrating a method of operating a display apparatus according to an exemplary embodiment.

FIG. 13 is a flow chart illustrating a method of operating a display apparatus according to an exemplary embodiment.

Referring to FIGS. 1, 2, 3 and 13, in the method of operating the display apparatus according to an exemplary embodiment, the output image data DO11 is generated based on the input image data DI11 and the gamma lookup table L11 (step S100). The output image data DO21 is generated based on the input image data DI21 and the gamma lookup table L21 (step S200). The display panel 100 operates based on the output image data DO11 during the driving duration DP1 (step S300), and operates based on the output image data DO21 during the driving duration DP2 subsequent to the driving duration DP1 (step S500). Thus, an image is displayed on the first display region DA1 of the display panel 100.

In an exemplary embodiment, the temporal smoothing operation may be performed to reduce discontinuity between the output image data DO11 and the output image data DO21 during the smoothing duration SP1 between the driving duration DP1 and the driving duration DP2 (step S400). For example, the smoothing image data SD11 may be generated by performing the interpolation based on the output image data DO11 and the output image data DO21, and the display panel 100 may operate based on the smoothing image data SD11 during the smoothing duration SP1.

In an exemplary embodiment, based on the example described above with reference to FIGS. 3, 4 and 5, the plurality of image data DO11~DO42 and SD11~SD42 may be generated, and the display panel 100 may display the image on the first display region DA1. In an exemplary embodiment, based on the example described above with reference to FIGS. 7, 8 and 9, the plurality of image data DO11'~DO42' and SD11'~SD42' may be generated, and the display panel 100 may display the image on the first display region DA1. In addition, in the operation of the display apparatus 10 for the second display region DA2 of the display panel 100, the temporal L-DAG driving scheme may be entirely or partially employed on the display panel 100.

Although exemplary embodiments are described based on examples where the display panel includes two display regions and each display region operates based on two or more gamma lookup tables, the temporal L-DAG driving scheme according to an exemplary embodiments may be employed where a display panel includes any number of display regions and each display region operates based on any number of gamma lookup tables. In addition, although exemplary embodiments are described where the display apparatus operates during four driving durations (e.g., in FIGS. 5 and 9), the temporal L-DAG driving scheme may be employed where a display apparatus operates during any number of driving durations. For example, the example in FIG. 5 and/or the example in FIG. 9 may be repeated for each of four driving durations.

The above described embodiments may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, a smart card, a printer, or the like.

The foregoing is illustrative of exemplary embodiments and is not to be construed as limiting thereof. Although a few exemplary embodiments have been described, those of ordinary skill in the pertinent art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other embodiments, are intended to be included within the scope of the appended claims.

What is claimed is:

1. A display apparatus comprising:

a timing controller configured to generate first output image data based on first input image data and a first gamma lookup table, and configured to generate second output image data based on second input image data and a second gamma lookup table; and a display panel configured to operate based on the first output image data during a first duration, and configured to operate based on the second output image data during a second duration subsequent to the first duration, wherein the first and second gamma lookup tables correspond to a same region of the display panel, and the first and second gamma lookup tables differing to cause luminance of an image based on the first gamma lookup table to differ from luminance of an image based on the second gamma lookup table and to cause a residual direct current (DC) voltage in the display panel to decrease prior to saturation of the residual DC voltage.

2. The display apparatus of claim 1, wherein the timing controller further performs a temporal smoothing operation to reduce discontinuity between the first output image data and the second output image data during a third duration between the first duration and the second duration.

3. The display apparatus of claim 2, wherein the timing controller further generates at least one smoothing image data by performing an interpolation based on the first output image data and the second output image data, and wherein the display panel operates based on the at least one smoothing image data during the third duration.

4. The display apparatus of claim 1, wherein the luminance of the image based on the first gamma lookup table is higher than the luminance of the image based on the second gamma lookup table.

5. The display apparatus of claim 4, wherein the residual DC voltage in the display panel increases during the first duration and decreases during the second duration.

6. The display apparatus of claim 1, wherein the timing controller further generates third output image data based on third input image data and a third gamma lookup table, and further generates fourth output image data based on fourth input image data and one of the third gamma lookup table or a fourth gamma lookup table, wherein the display panel operates based on the first output image data and the third output image data during the first duration, and operates based on the second output image data and the fourth output image data during the second duration, and wherein the same region is a first partial region of the display panel and the third and fourth gamma lookup tables correspond to a second partial region of the display panel, and a luminance of an image based on the third gamma lookup table is different from the luminance of the image based on the first gamma lookup table and a luminance of an image based on the fourth gamma lookup table.

7. The display apparatus of claim 6, wherein the timing controller further performs a spatial smoothing operation to reduce discontinuity between the first output image data and the third output image data during the first duration.

8. The display apparatus of claim 1, wherein the timing controller further generates third output image data based on third input image data and the first gamma lookup table, and further generates fourth output image data based on fourth input image data and the second gamma lookup table, and wherein the display panel operates based on the third output image data during a third duration subsequent to the second duration, and operates based on the fourth output image data during a fourth duration subsequent to the third duration.

9. The display apparatus of claim 1, wherein the timing controller further generates third output image data based on third input image data and the first gamma lookup table, and further generates fourth output image data based on fourth input image data and a third gamma lookup table, wherein the display panel operates based on the third output image data during a third duration subsequent to the second duration, and operates based on the fourth output image data during a fourth duration subsequent to the third duration, and wherein the third gamma lookup table corresponds to said same region of the display panel, and a luminance of an image based on the third gamma lookup table is different from the luminance of the image based on the first gamma lookup table and the luminance of the image based on the second gamma lookup table.

10. The display apparatus of claim 9, wherein the luminance of the image based on the first gamma lookup table is lower than the luminance of the image based on the second gamma lookup table, and is higher than the luminance of the image based on the third gamma lookup table.

11. The display apparatus of claim 1, wherein a length of at least one of the first duration or the second duration is variable.

12. The display apparatus of claim 11, wherein the timing controller determines a type of a first image displayed on the display panel based on the first output image data and the second output image data, and changes the length of the at least one of the first duration and the second duration based on the type of the first image.

13. The display apparatus of claim 12, wherein the timing controller increases the length of the at least one of the first duration and the second duration when the first image corresponds to a dynamic image, and decreases the length of the at least one of the first duration and the second duration when the first image corresponds to a static image.

14. The display apparatus of claim 11, wherein the timing controller changes the length of the at least one of the first duration and the second duration based on a flag signal indicating a type of an image displayed on the display panel.

15. A method of operating a display apparatus, the method comprising:

generating first output image data based on first input image data and a first gamma lookup table;

generating second output image data based on second input image data and a second gamma lookup table;

operating a display panel in the display apparatus based on the first output image data during a first duration; and operating the display panel based on the second output image data during a second duration subsequent to the first duration, wherein the first and second gamma lookup tables correspond to a same region of the display panel, and the first and second gamma lookup tables differing to cause a luminance of an image based on the first gamma lookup table to differ from a luminance of an image based on the second gamma lookup table, and to cause a residual direct current (DC) voltage in the display panel to decrease prior to saturation of the residual DC voltage.

16. The method of claim 15, further comprising:

performing a temporal smoothing operation to reduce discontinuity between the first output image data and the second output image data during a third duration between the first duration and the second duration.

17. A display timing controller comprising:

a gamma compensator configured to provide a plurality of output data sets for a corresponding plurality of successive time lapse periods based on: (i) a corresponding plurality of input data sets, respectively, and (ii) at least first and second gamma function sets, wherein each ordered element of each set corresponds to a like-ordered image display area, respectively, and wherein the first gamma function set is used for a first one of the time lapse periods and the second gamma function set is used for a second one of the time lapse periods, and the first and second gamma function sets differing to cause a residual direct current (DC) voltage in the display panel to decrease prior to saturation of the residual DC voltage.

18. The display timing controller of claim 17, further comprising: a temporal smoother configured to provide a plurality of temporally smoothed data sets, each temporally smoothed data set to be displayed between successive output data sets corresponding to successive time lapse periods, respectively, wherein each ordered element of each of the temporally smoothed data sets corresponds to a like-ordered image display area, respectively.

19. The display timing controller of claim 17 wherein each of the plurality of gamma function sets comprises different gamma functions corresponding to different display areas, respectively, for at least one time lapse period.

20. The display timing controller of claim 17 wherein each of the plurality of gamma function sets comprises different gamma functions for a periodically repeating subset of the successive time lapse periods, respectively.

* * * * *